United States Patent [19]

Berger et al.

[11] Patent Number: 4,571,961

[45] Date of Patent: Feb. 25, 1986

[54] CLAMPING DEVICE

[76] Inventors: Johann Berger, Obere Schloss-Strasse 114, D-7071 Alfdorf; Josef Berger, Hainstrasse 11, D-7070 Schwaebisch Gmuend - Grossdeinbach, both of Fed. Rep. of Germany

[21] Appl. No.: 737,457

[22] Filed: May 24, 1985

[30] Foreign Application Priority Data

Jun. 2, 1984 [DE] Fed. Rep. of Germany ..... 3420693

[51] Int. Cl.[4] ..... D04B 23/00

[52] U.S. Cl. ..... 66/208; 66/114

[58] Field of Search ..... 66/208, 114

[56] References Cited

U.S. PATENT DOCUMENTS

| | | | |
|---|---|---|---|
| 2,902,847 | 9/1959 | Kohl | 66/114 |
| 2,995,911 | 8/1961 | Wenrich | 66/114 |
| 3,811,298 | 5/1974 | Kohl | 66/208 |
| 3,823,581 | 7/1974 | Russo | 66/208 |

FOREIGN PATENT DOCUMENTS

| | | | |
|---|---|---|---|
| 2444740 | 8/1980 | France | 66/114 |

*Primary Examiner*—Ronald Feldbaum
*Attorney, Agent, or Firm*—Wells & Wells

[57] ABSTRACT

A clamping device for attaching crochet needles to the needle bar of a galloon crochet machine or Raschel loom. The clamping device consists of two body pieces, a lower piece and a clamping lid, which are fastened together by means of clamps. In one embodiment the body piece holds the needle shafts, a spacer inserted into each interval between needles, and a support piece between the shafts of a needle and a receptacle in the lower piece. This results in the formation of needle beds. In the other embodiment very shallow grooves are milled opposite one another in both body pieces. These are only a fraction of half the height of the needle shafts, leaving the major part of the needle shaft's height free after clamping.

5 Claims, 4 Drawing Figures

CLAMPING DEVICE

BACKGROUND OF THE INVENTION

The present invention relates to a clamping device for crochet needles (hereafter called "needles"). Such clamping devices are used in galloon crochet machines (also called crochet galloon machines) of the type described, for example, in European patent publication No. 110 271. The clamping device can also be used in Raschel looms. It is always attached to the needle bar in these machines.

There is a need to produce bands with 10 or more threads per centimeter width on a galloon crochet machine or Raschel loom. This is particularly important in the case of elastic bands, such as those used in underwear and sportswear.

It is known from U.S. Pat. No. 4,137,730 that a group of crochet needles may be set into a clamping device, wherein spacers ensure the distance between needles. This allows the needles to be clamped close together, however, if it should be necessary at a later stage to replace a broken needle, the entire group of needles must be released and carefully restored once the needle has been replaced. This represents a considerable waste of time.

On the other hand, it is known from U.S. Pat. No. 3,823,581 that grooves may be milled close together into one of the body pieces of the clamping device, each of which acts as a receptacle for the shaft of a needle.

A similar arrangement is known from the above-mentioned European patent publication No. 110 271, FIGS. 8 and 9. The grooves are at least almost as deep as the height of the shafts. There are limits to the number of grooves which can be milled into a centimeter width of one of the body pieces of the clamping device. If the number of grooves is increased to over ten per centimeter width, ridges of 0.2 mm thickness and less are resulting between the grooves. This cannot be avoided by the use of thinner needles, since the needles must have a certain strength, and the use of needles thinner than 0.4 mm is impractical.

If a gang cutter is used to mill the grooves, it is possible to mill a group of adjacent grooves in one operation, however even then it is technically impossible to mill grooves with intermittent ridges of 0.2 mm or less without this resulting in a relatively high level of wastage caused by broken ridges.

The present invention solves the problem of clamping more than 10 needles per centimeter width in two different ways.

SUMMARY OF THE INVENTION

In one form of the invention, there is provided a clamping device for attaching crochet needles to the needle bar of a galloon crochet machine or Raschel loom with the following features:

(a) The clamping device comprises two body pieces which may be fastened together by clamping means and one of which is adapted to be fastened to the needle bar;

(b) One of the body pieces serves as a means for receiving for the needle shafts;

(c) The device includes spacers adapted to be inserted between the needle shafts, characterised by the following features:

(d) One of the body pieces has receptacles, each for one group of needles;

(e) Support pieces having the thickness of the needle shafts are provided for insertion between the individual spacers, and between the floors of the receptacles and the needle shafts.

Spacers are arranged between the shafts of the needles, as in U.S. Pat. No. 4,137,730, but in a manner allowing each needle to be exchanged individually. This is achieved by inserting not only the needles themselves, but also support pieces between the spacers. Thus the support pieces and the spacers form a comb-like structure into which the shafts of the needles may be inserted individually. Since there are no obstacles to the use of very thin spacers, the number of needles which may be housed per centimeter width is limited only by the necessary thickness of the needle shafts and the necessary distances of the working areas of the needles.

Groups of support pieces and spacers are placed in one of the body pieces, and individual needles may be easily replaced once the clamping means have been released.

If the support pieces and the spacers are glued together, there is increased protection against other parts being displaced when a needle is changed.

In another form of the invention, there is provided a clamping device for attaching crochet needles to the needle bar of a galloon crochet machine or Raschel loom with the following features:

(a) The clamping device has two body pieces which may be fastened together by means of clamping means, and one of which is adapted to be attached to the needle bar;

(b) The clamping device has grooves, each of which holds the shaft of one needle, characterised by the following features:

(c) The grooves are arranged opposite one another in the two body pieces, and their depth is only a fraction of half the height of the needle shafts.

The grooves are of minimal depth, so the danger of damaging the ridges between the grooves is eliminated. For the reliable insertion of needle shafts, grooves are arranged opposite one another, some in one body piece, others opposite them in the other body piece. These grooves only grasp a very small part of the needle shafts, much less than half the height of a needle shaft, so that the greater portion of the needle shaft lies outside of the groove.

If the body is made of light metal, the inertial mass of the clamping device, which is under constant acceleration during the backwards and forwards movement of the needle bar, is reduced, thereby allowing the possible working speed of the machine to be increased.

BRIEF DESCRIPTION OF THE DRAWINGS

The invention will now be described by way of example with reference to the accompanying drawings, in which.

SPECIFIC DESCRIPTION

Figure 1:
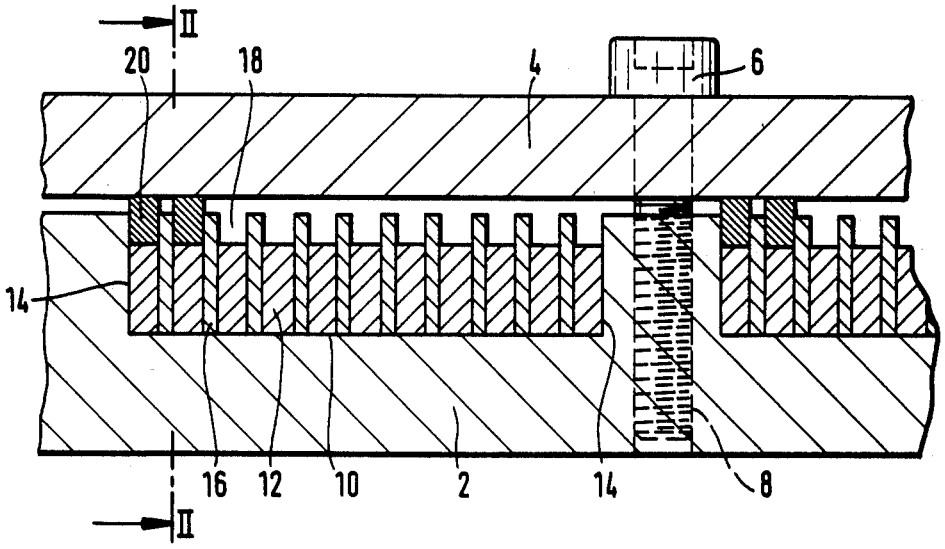
FIG. 1 shows a section through a first embodiment of clamping device according to the invention, at right angles to the axis of the needles.
Figure 2:
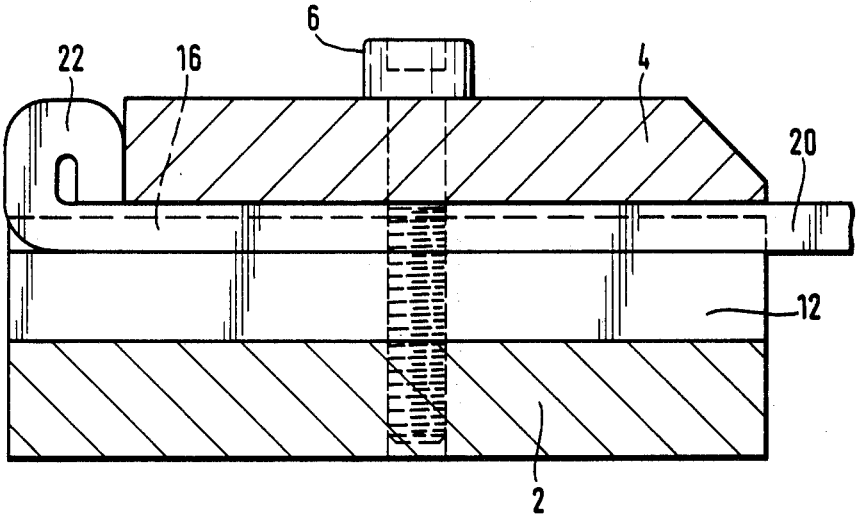
FIG. 2 shows a section shown at the line II—II in FIG. 1, i.e. parallel to the length of the needles.

The first embodiment of clamping device shown in FIGS. 1 and 2 has two body pieces made of light metal—a lower piece 2 and a clamping lid 4. To secure the clamping lid 4 against the lower piece 2, bolts 6 are used as clamping means. These screw into threaded holes 8 in the lower piece through cylindrical openings in the clamping lid. The lower piece 2 has receptacles 10 in the form of throughs with rectangular section. A group of support pieces 12 is arranged in each receptacle 10. The outermost of these rest against the side surfaces 14 of the receptacles 10. Between every pair of support pieces there is a spacer 16. The support pieces have a smaller height than the spacers, resulting in a comb-like structure with needle beds 18. The support pieces 12 have the same thickness as the shafts 20 of the needles to be inserted.

The thicknesses of the needle shafts 20, the support pieces 12 and the spacers 16 as well as the widths of the receptacles 10 are chosen to allow a press-fit of a whole number of support pieces and needle shafts into the receptacle, with a needle shaft lying against each side wall 14 at either extremity.

The needles 10 have one bent end 22, and are inserted in such a way that this end fits against the rear surface of the clamping lid 4. Thus all are aligned longitudinally in the simplest fashion. This also allows the simplest replacement and alignment of individual needles.

The spacers and support pieces may be glued together. This arrangement allows a single needle to be exchanged after the clamping lid has been released, while leaving all others undisturbed in the needle beds 18.

As indicated in FIGS. 1 and 2, the clamping device is of simple design, and may be manufactured at low cost. The parts required for attaching the needle bar to a galloon crochet machine or Raschel loom have not been represented here, but will be known by those skilled in the art.

Two numerical examples may serve to illustrate that the invention facilitates the insertion of a relatively large number of needles per centimeter width of the receptacle 10.

| | Example 1 | Example 2 |
|---|---|---|
| | Thicknesses in mm | |
| needles | 0,5 | 0,4 |
| spacers | 0,2 | 0,15 |
| sum | 0,7 | 0,55 |
| needles/cm | 14,3 | 18,2 |

The heights of the parts to be inserted into a receptacle 10 could, by way of example, have the following values:

| | |
|---|---|
| Support pieces | 5,0 mm |
| spacers | 6,0 mm |
| needles | 1,5 mm |

The support pieces and the spacers may be made of soft iron or steel. What is important is that they are of uniform thickness along their entire length.

Figure 3:
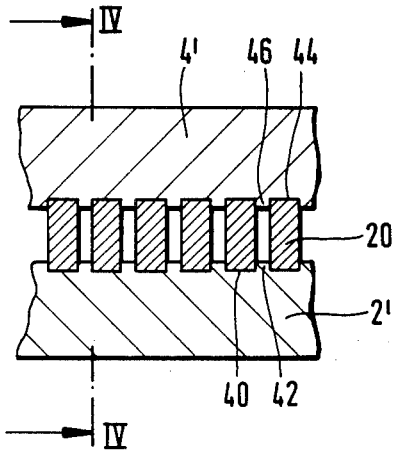
FIG. 3 shows a section corresponding to that of FIG. 1 through a second embodiment of clamping device according to the invention.
Figure 4:
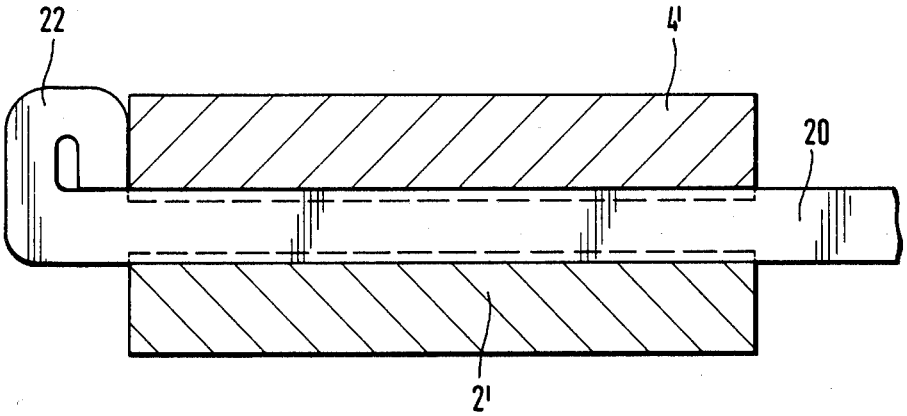
FIG. 4 shows a section at the line IV—IV in FIG. 3, i.e. parallel to the length of the needles.

In the second embodiment shown in FIGS. 3 and 4, the clamping device also has a lower piece 2' and a clamping lid 4'. These may be connected to one another by means of bolts not represented here. Very shallow grooves 40 have been milled in the lower piece, leaving intermittent ridges 42 whose width is significantly less than that of the grooves. Grooves 44 of the same dimensions are milled into the clamping lid 4', with intermittent ridges 46 of the same width as in the lower piece. The depth of the grooves 40 and 44 is considerably less than half the height the needle shafts 20, so that the major portion of the length of the needle shafts is free.

All grooves for a group of needles are milled simultaneously using a gang cutter. Due to the minimal depth of the grooves there is no reason to fear that the ridges 46 might be damaged.

The ridges may have the same width as that given above for the thickness of the spacers.

The rear ends 22 of the needles 20 again sit against the rear end of the clamping lid 4'. This again allows the alignment of any grouping of needles, either after the initial insertion of the needles, or after individual needles have been replaced.

This embodiment also includes bolts as clamping means, which have, however, for the sake of simplicity not been represented.

In both embodiments individual needles may be replaced by loosening the bolts, without removing them, pulling the needles out backwards and inserting new ones, arranging the group of needles against the clamping lid 4 or 4' and re-tightening the bolts.

We claim:

1. A clamping device for attaching crochet needles to the needle bar of a galloon crochet machine or Raschel loom, with the following features:

(a) The clamping device comprises two body pieces which may be fastened together by clamping means and one of which is adapted to be fastened to the needle bar;

(b) One of the body pieces serves as a means for receiving the needle shafts;

(c) The device includes spacers adapted to be inserted between the needle shafts, characterised by the following features:

(d) One of the body pieces has receptacles, each for one group of needles;

(e) Support pieces having the thickness of the needle shafts are provided for insertion between the individual spacers, and between the floors of the receptacles and the needle shafts.

2. A clamping device as claimed in claim 1, characterised by the fact that the support pieces and the spacers are glued together.

3. A clamping device as claimed in claim 1, characterised by the following features:

(a) The receptacles are in the form of troughs with rectangular section;

(b) Each side wall of the receptacles serves as a lateral support for an additional support piece and an additional needle.

4. A clamping device for attaching crochet needles to the needle bar of a galloon crochet machine or Raschel loom, with the following features:

(a) The clamping device has two body pieces which may be fastened together by means of clamping means, and one of which is adapted to be attached to the needle bar;

(b) The clamping device has grooves, each of which holds the shaft of one needle, characterised by the following features:

(c) The grooves are arranged opposite one another in the two body pieces, and their depth is only a fraction of half the height of the needle shafts.

5. A clamping device as claimed in any one of the preceding claims, characterised by the fact that the body pieces are made of light metal.

* * * * *